US010264927B2

(12) United States Patent
Brewer et al.

(10) Patent No.: US 10,264,927 B2
(45) Date of Patent: Apr. 23, 2019

(54) BRUSHHEAD FOR USE WITH A NON-NEWTONIAN COSMETIC COMPOSITION

(71) Applicant: L'Oreal, Paris (FR)

(72) Inventors: Gerald K Brewer, Redmond, WA (US); Aaron D Poole, Federal Way, WA (US); Kelly M George, Denville, NJ (US); Mickaël Poletti, Seattle, WA (US)

( * ) Notice: Subject to any disclaimer, the term of this patent is extended or adjusted under 35 U.S.C. 154(b) by 278 days.

(21) Appl. No.: 15/254,367

(22) Filed: Sep. 1, 2016

(65) Prior Publication Data

US 2016/0367086 A1 Dec. 22, 2016

Related U.S. Application Data

(62) Division of application No. 14/585,464, filed on Dec. 30, 2014, now Pat. No. 9,474,358.

(51) Int. Cl.

| | |
|---|---|
| ***A46B 13/02*** | (2006.01) |
| ***A47K 7/04*** | (2006.01) |
| ***A46B 9/02*** | (2006.01) |
| ***A46B 13/00*** | (2006.01) |
| ***A46B 11/00*** | (2006.01) |
| ***A46B 15/00*** | (2006.01) |
| ***A47K 7/03*** | (2006.01) |
| ***A46B 13/04*** | (2006.01) |
| *A46B 9/06* | (2006.01) |

(52) U.S. Cl.

CPC ..... *A47K 7/043* (2013.01); *A46B 9/021* (2013.01); *A46B 11/0006* (2013.01); *A46B 13/008* (2013.01); *A46B 13/02* (2013.01); *A46B 13/04* (2013.01); *A46B 15/0006* (2013.01); *A47K 7/03* (2013.01); *A47K 7/04* (2013.01); *A46B 9/06* (2013.01); *A46B 11/0068* (2013.01); *A46B 2200/1046* (2013.01)

(58) Field of Classification Search

CPC . A47K 7/043; A47K 7/03; A47K 7/04; A46B 9/02; A46B 11/0006; A46B 13/008; A46B 13/02; A46B 13/04; A46B 15/0006

See application file for complete search history.

(56) References Cited

U.S. PATENT DOCUMENTS 5,891,063 A * 4/1999 Vigil ..... A46B 13/02 15/207.2

* cited by examiner

*Primary Examiner* — Shay Karls

(74) *Attorney, Agent, or Firm* — Jensen & Puntigam, P.S.; Clark A. Puntigam

(57) ABSTRACT

The brushhead includes a brushhead base member and at least one outer ring of bristles mounted thereto, the brush base member being non-oscillating. An inner assembly is adapted to capture a solid, semi-solid, gel or the like non-Newtonian balm element having shear thinning characteristics. In an embodiment, the inner assembly is adapted to receive energy from an oscillating action of the inner assembly produced by a motor in the appliance to which the brushhead is attachable. Oscillation of the inner portion at a selected frequency and amplitude results in the solid, semi-solid, gel or the like balm element changing to a liquid in a shear thinning effect, the liquid being useful for removal of makeup.

7 Claims, 5 Drawing Sheets

BRUSHHEAD FOR USE WITH A NON-NEWTONIAN COSMETIC COMPOSITION

PRIOR APPLICATION

This is a divisional application of currently pending application No. 14/585,464, filed on Dec. 30, 2014.

TECHNICAL FIELD

This disclosure is directed toward a brushhead having a configuration adapted for removing facial makeup, and more specifically concerns such a brushhead operating in a skin brush appliance with an oscillating action in the sonic frequency range.

BACKGROUND

For all those who use facial makeup, particularly on a regular basis, there is the ongoing requirement of effectively removing existing makeup before applying new makeup, both to maintain good skin health and also to facilitate the application of new makeup.

While facial makeup comprises a variety of formulations, which may have varying difficulty in removal, typical methods of makeup removal include pre-moistened towelettes, wipes or pads, or a liquid makeup removal product, applied with cotton pads or balls. Facial makeup must first be loosened from the skin and then lifted off and removed, again typically by wipes or soft pads. The process of makeup removal with these conventional methods is time-consuming and can be less than effective, depending upon the time and care devoted to the task, as well as the cleansing characteristics of the makeup remover itself.

Accordingly, a more effective, convenient and less time-consuming technique/process of makeup removal is desirable.

SUMMARY

Accordingly, the brushhead for use with a non-Newtonian cosmetic composition, comprises: a brushhead base member, the base member remaining fixed in position relative to an associated appliance during operation of the appliance; at least one outer ring of bristles mounted on the base member and adapted for comfortable contact with the skin; and an inner brushhead portion adapted to capture a solid, semi-solid or gel non-Newtonian cosmetic composition which has shear thinning characteristics, the inner portion further adapted to receive energy by virtue of an oscillating action on the inner portion produced by a motor assembly in the appliance to which the brushhead is attachable, wherein oscillation of the inner portion at a selected frequency and amplitude results in a change of state of the non-Newtonian cosmetic composition from solid, semi-solid or gel to liquid.

BEST MODE

Figure 1:
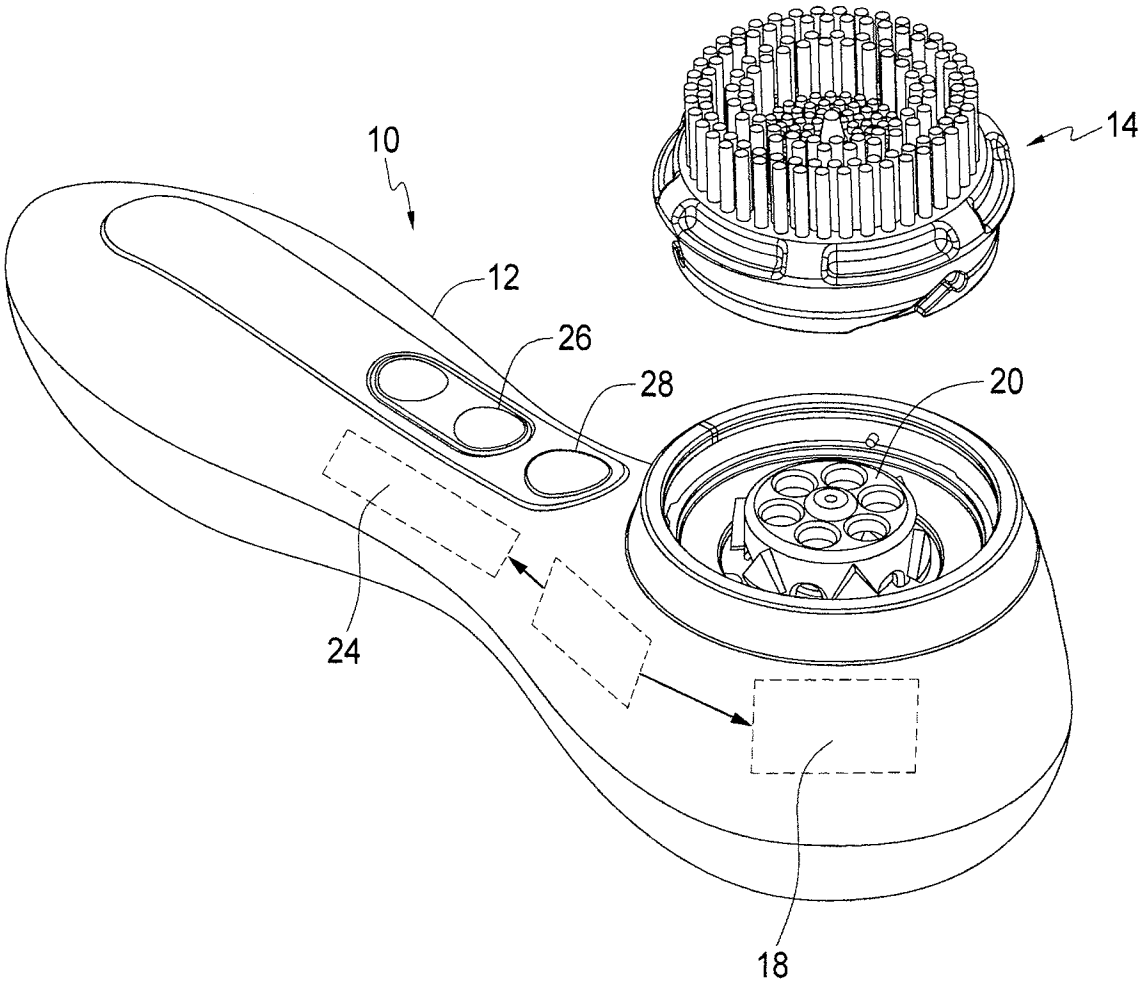
FIG. 1 is a schematic partially exploded view of a skin cleansing appliance with a skin brush in accordance with one embodiment.

FIG. 1 shows generally an appliance 10 which includes a handle 12 and a brushhead 14. In an embodiment, brushhead 14 is configured and adapted for makeup removal when the appliance is operated as described below. The particular handle 12 shown is for illustration purposes only. Various handles can be used with the brushhead shown and described herein. Handle 12 includes a drive assembly which includes a motor 18 which operates on a drive member 20 to which brushhead 14 is attachable. Brushhead 14 can easily be fitted to and removed from the drive member and the handle. The motor 18 is powered by a rechargeable battery 22 and controlled by a microprocessor 24. The microprocessor can be programmed to provide various frequencies and amplitudes for movement of the brushhead in an oscillatory manner. One particular combination of frequency and amplitude can be used to drive the makeup removal brushhead. The handle includes an on/off switch 26 for control and operation of the appliance as well as a switch 28 for control of power increase.

FIGS. 2-5 show several embodiments of the makeup removal brushhead, referred to hereinafter as the brushhead. The embodiments of FIGS. 2-5 are representative of a variety of brushhead arrangements which are possible relative to providing, among other things, effective makeup removal when used with an appliance having the operational characteristics described below. The brushhead is used with a non-Newtonian solid, semi-solid, gel or the like dose/tablet of a balm that in liquid form is effective in removing makeup from the skin. In the embodiment shown, the brushhead is driven at a frequency within the range of 60-300 Hz, preferably approximately 175 Hz, with an oscillating motion having an oscillation amplitude in the range of 3-18° peak-to-peak, preferably approximately 9° tangential.

In operation, with each of the embodiments, kinetic energy from the oscillating motor is coupled into the brush, which is oscillating at the above-noted frequency and amplitude. In an embodiment, the non-Newtonian solid, semi-solid, gel or the like dose of a formulation which reversibly transforms from a solid, semi-solid, gel or the like in the presence of an applied energy stimulus. In an embodiment, once the applied energy stimulus is stopped, the non-Newtonian solid, semi-solid, gel or the like dose returns to its solid, semi-solid, gel or the like state. In an embodiment, the non-Newtonian solid, semi-solid, gel or the like dose of a formulation reversibly transforms from a solid, semi-solid, gel or the like to a liquid by the kinetic energy coupled to the brush, with the liquid then applied to the human skin for removal of makeup, application of a cosmetic coating and the like. The non-Newtonian shear thinning material changes state from a solid, semi-solid, gel or the like to a liquid in the presence of an applied energy stimulus, and changes back to a solid, semi-solid, gel or the like in the absence of the applied energy stimulus. A shear thinning material by definition is one in which when an applied shear stress is increased, the material's viscosity decreases in a nonlinear way. This results in the material changing its state from a solid, semi-solid, gel or the like to a liquid. In the present case, this permits a solid, semi-solid, gel or the like tablet of balm to be initially conveniently and reliably anchored or staked to the brushhead. The appliance with the brushhead can then be elevated to a vertical position adjacent the skin without the solid, semi-solid, gel or the like tablet falling out or a liquid spilling away.

The coupling of the kinetic energy from the motor to the brushhead and to the solid, semi-solid, gel or the like balm tablet can be accomplished in a number of ways with the present brushhead. First, the brushhead in one or more embodiments has filaments or other flexible members such that when the brushhead is oscillated, the filaments will flex and move, rubbing against the non-Newtonian solid, semi-solid, gel or the like balm tablets staked in the brushhead. Further, kinetic energy may be coupled directly to the brushhead through the use of a stake or stakes or other elements fixedly contacting the solid, semi-solid, gel or the like balm element. Still further, the solid, semi-solid, gel or the like balm element can be staked or held in such a way in the brushhead that when the brushhead oscillates, the balm tablet contacts a region of the skin and by virtue of the shear forces in that particular plane, the non-Newtonian solid, semi-solid, gel or the like dose changes to a liquid for effective removal of makeup.

Figure 2:
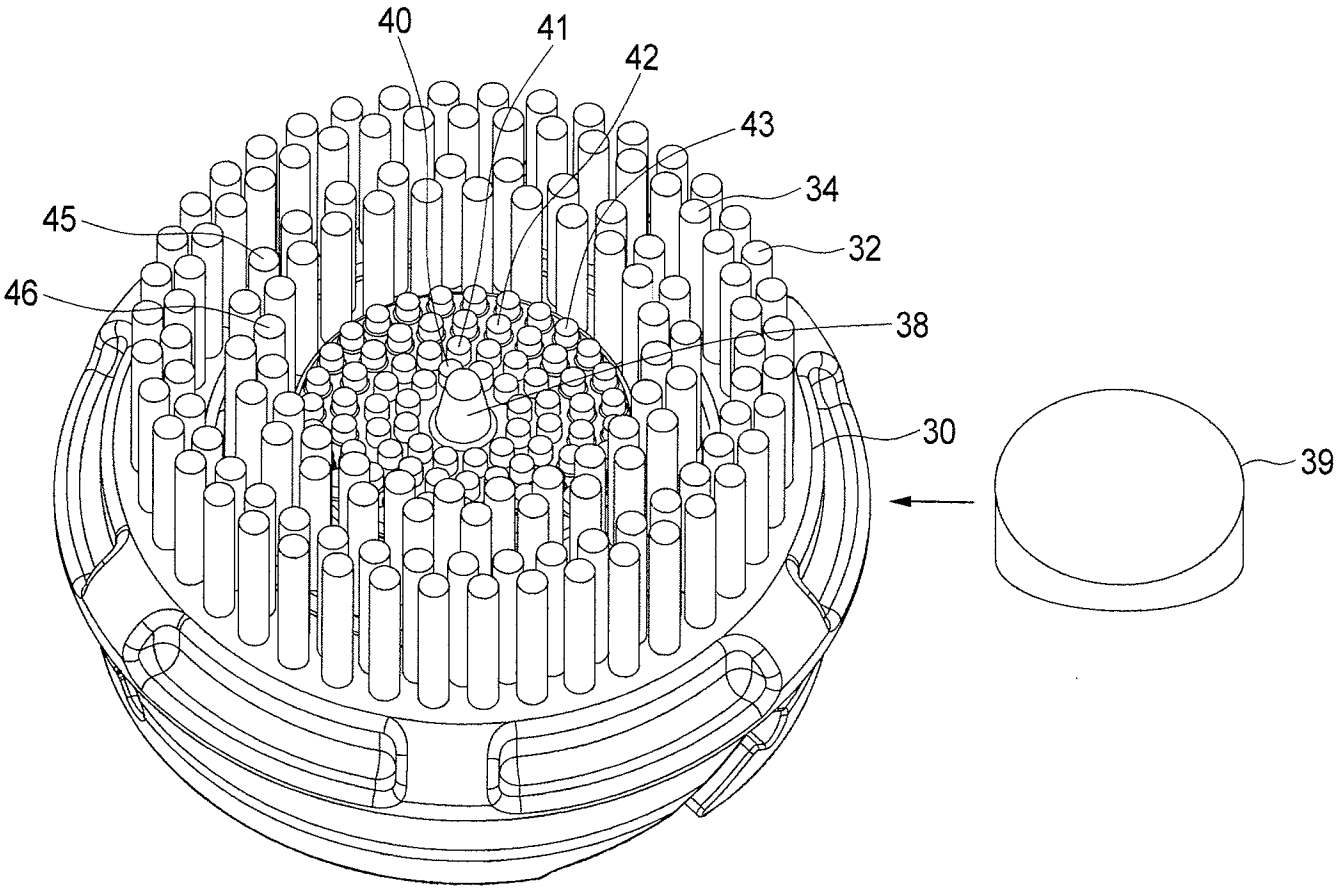
FIG. 2 is a schematic diagram of one embodiment of a brushhead and an accompanying solid, semi-solid, gel or the like non-Newtonian makeup removal member.

One embodiment is shown in FIG. 2. It includes a brushhead base 30 which is configured and adapted to mate with the drive member in the handle as shown in FIG. 1. One arrangement for such a connection is shown in U.S. Pat. No. 7,386,906, which is owned by the assignee of the present invention and which are both hereby incorporated by reference. The base 30 is fixed and does not oscillate in operation of the appliance. The embodiment of FIG. 2 includes two outer rings of tufts 32 and 34 of bristles. In the embodiment shown, the two rings of tufts are mounted in the base 30, and hence do not move in operation of the appliance. They are constructed with 3-4 mil DuPont supersoft filaments with a trim height of 0.425 inches, end-rounded and polished, with normal filament packing in each tuft. These two rings of tufts form the outer boundaries of the brushhead and serve, among other purposes, as a protective shield against splatter, and also assist in lifting off makeup.

In an embodiment, the inner portion of the brush includes at its center a stake element 38 which in the embodiment shown is a plastic silicon part with a Shore hardness of 40A in the embodiment shown. The stake 38 is approximately 0.2 inches high and is approximately conical in shape. Stake 38 serves as an anchoring member for the non-Newtonian dose element 39. In an embodiment, the stake 38 includes symmetrical or non-symmetrical structures to further help anchor a non-Newtonian solid, semi-solid, gel or the like tablet. In an embodiment, one or more regions of the inner portion include tufts or bristles of elastomeric protrusions arranged in regular or irregular patterns.

Surrounding the stake 38 in the embodiment shown in FIG. 2 are four rings of silicon protrusion elements 40-43 that will vary in height from embodiment to embodiment from 0.05 inches to 0.35 inches, with a diameter of 0.06 inches. The stake element will always be taller than the rings of protrusions. The spacing of the rings of protrusions is approximately between 0.06 inches and 0.09 inches. In any one embodiment, the height of the elastomeric protrusions will be approximately the same. The dimensions can vary to some extent. The lower surface of the balm dose 39 will contact the ring's elastomeric protrusions. The remainder of the inner brushhead portion comprises two rings 45 and 46 of filaments, although one or more additional rings of filaments can also be used. These rings have a height of 0.425 inches and are comprised in the embodiment shown of 3-4 mil DuPont supersoft filaments, which are end-rounded and polished, to permit a gentle interaction with the skin. The DuPont supersoft material is used for its ability to pick up and remove makeup as well as being comfortable for the user.

Materials of different stiffness in the driven brushhead can cause an out-of-phase motion between those materials. In the case of the present brushhead, the motion is approximately 140°-180° out-of-phase between the innermost ring 46 of DuPont supersoft filaments in the inner brushhead portion and the outermost (fourth) row 43 of elastomeric protrusions. When the loaded inner brushhead portion moves at 175 Hz with an amplitude in the range of 4-9°, with radii of the two above elements at 0.335 inches and 0.375 inches, respectively, directional velocities of 8.03-18.50 inches per second and 9.08-20.56 inches per second result. Since the above two elements of the inner brushhead are moving, respectively, within the two velocity ranges described above, 140°-180° out-of-phase, the relative velocity between the two rings of elements is much higher than that indicated above. The relative velocity, i.e. the sum of the two individual velocities, that the solid, semi-solid, gel or the like balm tablet would experience would range from 7.06 inches per second to 39.06 inches per second. Within this range of relative velocity, the balm tablet shear thins from solid, semi-solid, gel or the like to a liquid under normal loading conditions. The liquid makeup remover formulation, with the oscillating action of the inner portion of the brushhead, operates to effectively and quickly remove facial makeup.

Figure 3:
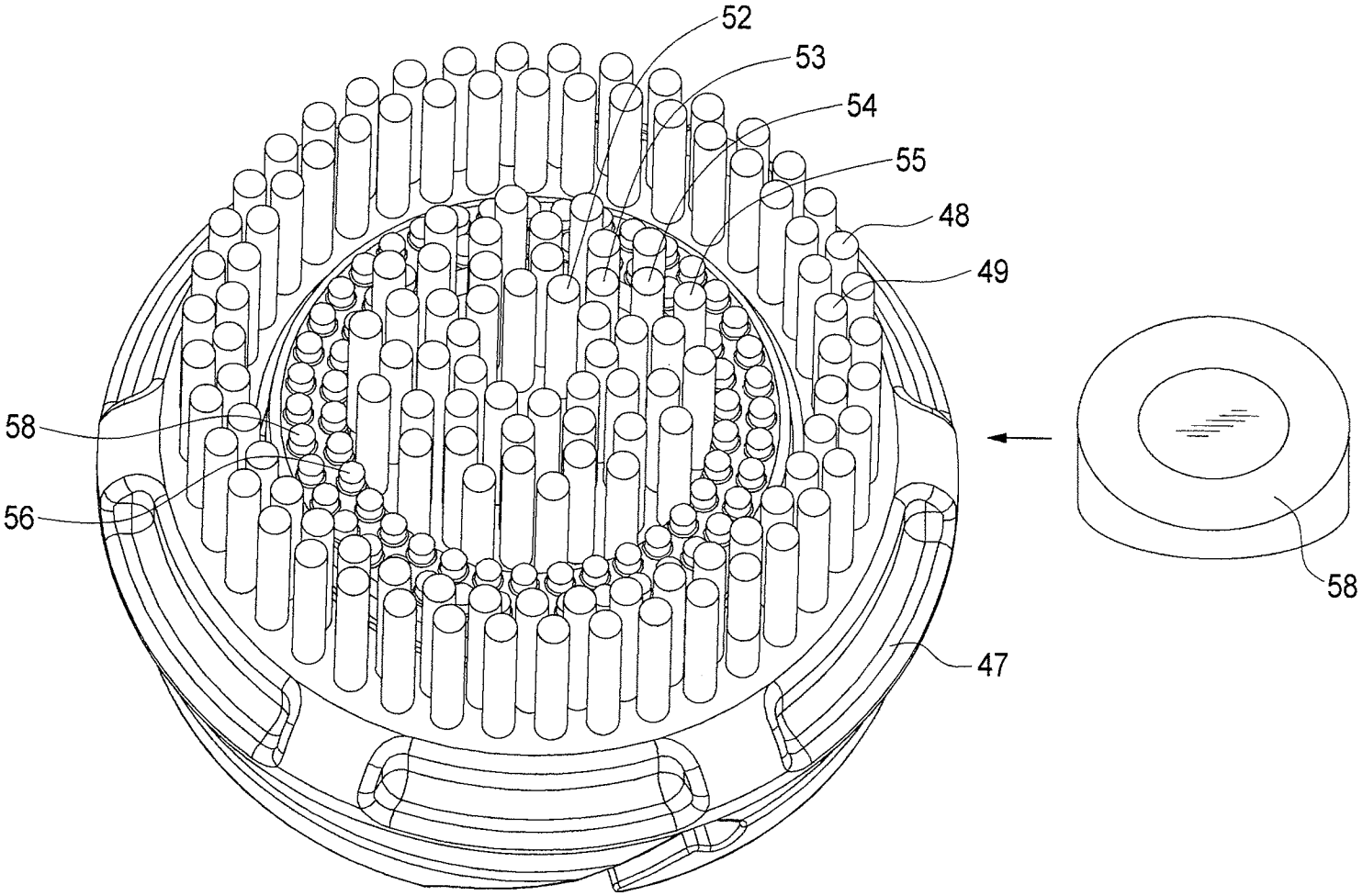
FIG. 3 is a schematic view of another embodiment of the brushhead and accompanying solid, semi-solid, gel or the like non-Newtonian makeup removal member.

A second embodiment is shown in FIG. 3. This embodiment is similar to the embodiment of FIG. 2, in that it includes the same brushhead base 47 and two fixed outer rings 48 and 49, with similar material and sizing as the embodiment of FIG. 2. The oscillating inner brushhead portion includes a center portion of filament rings, comprising filaments which are similar to the filaments comprising rings 44 and 46. These filaments form four concentric rings 52-55. The outside diameter of ring 55 in the embodiment shown is approximately 0.84 inches. Positioned between the center portion filament rings 52-55 and the outer fixed rings 48 and 49 are two rings of elastomeric protrusions 56 and 58. These protrusions are approximately 0.06 inches high and have a diameter of approximately 0.06 inches. The non-Newtonian balm tablet 59 associated with this embodiment is doughnut-shaped, having an inner diameter and an outer diameter such that the tablet fits within the area between the center portion of filament rings and the fixed outer rings of filaments, contacting the intermediate rings of protrusions. The doughnut tablet is configured such that the sides of the outer row 55 of filaments holds the tablet in place when the appliance is lifted to a position where the brushhead contacts the skin. In operation, the shear thinning effect changes the tablet from a solid, semi-solid, gel or the like balm tablet to a liquid useful in makeup removal, by virtue of the various shear stress effects discussed above, including the differential motion effect described above with respect to the embodiment of FIG. 2.

Figure 4:
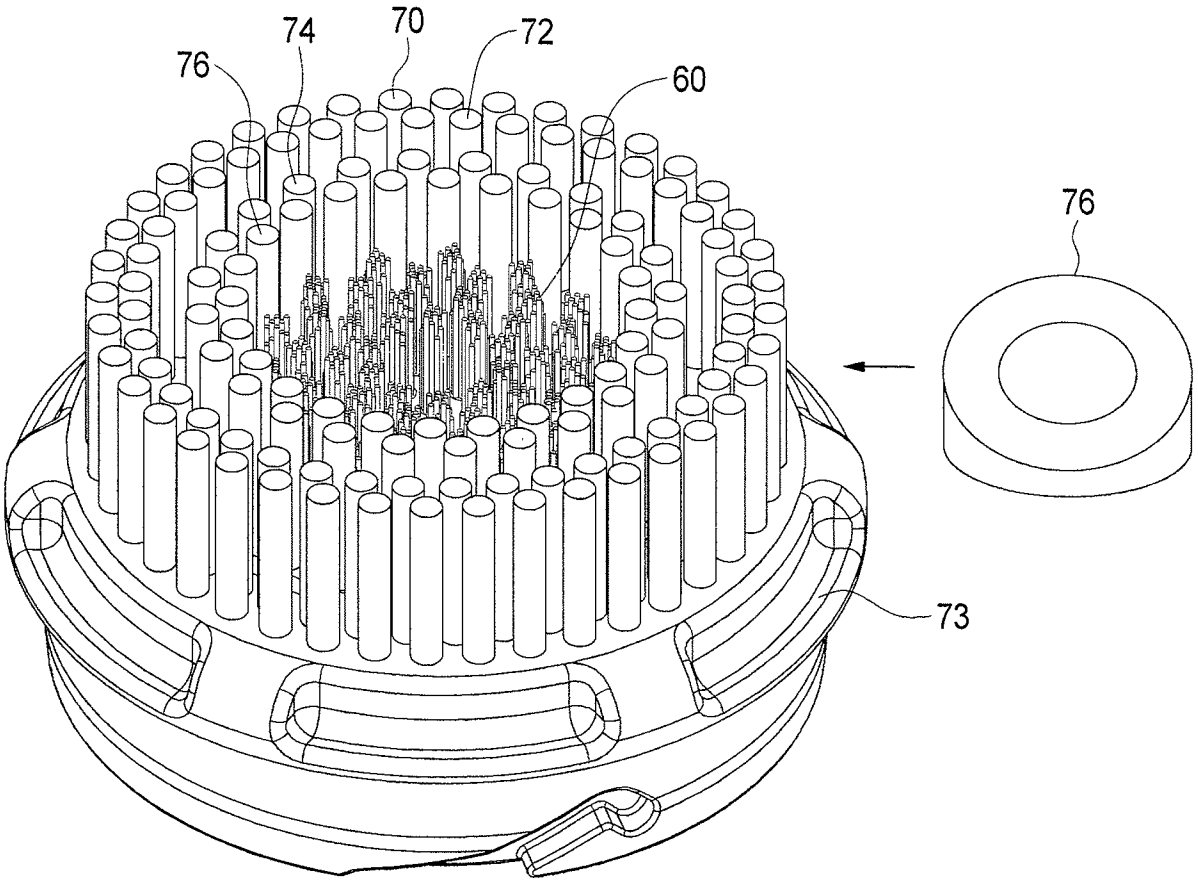
FIG. 4 is a schematic view of a still further embodiment of the brushhead and accompanying solid, semi-solid, gel or the like non-Newtonian makeup removal member.

FIG. 4 shows a further embodiment, in which the brushhead comprises all bristles, instead of including an elastomeric part of the inner brushhead (oscillating) portion. This embodiment includes an inner oscillating portion with a center portion 60 of four inner rings of 3-12 mil DuPont supersoft filaments cut to a height of 0.225 inches. The four rings of filaments will generally provide enough stiffness to properly seat and hold the solid, semi-solid, gel or the like balm tablet similar to that provided by the elastomeric protrusions of FIG. 3. The inner brush portion also includes two rings of outer filaments 74, 76 which are taller than the center portion rings 60. This embodiment also includes, similar to the embodiment of FIGS. 2 and 3, two outer rings 70, 72 which are fixed in position in brushhead base 73. Out-of-phase motion can be achieved between the outer ring of the center portion bristles and the inner ring 74 of the outer bristles of the inner brushhead portion to maintain a substantial differential velocity. In a preferred arrangement, the center portion bristles 60 of the oscillating inner portion are 0.012 inch PBT filament bristles in a staggered height varying from 0.240 to 0.280 inches, providing both stiffness to seat the balm tablet 78 as well as the out-of-phase motion to assist in shear thinning, as described above. In this embodiment, the two outer rings of the oscillating inner portion and the two outer fixed rings are still 3 mil DuPont supersoft with normal packing, 0.425 inches in height.

Figure 5:
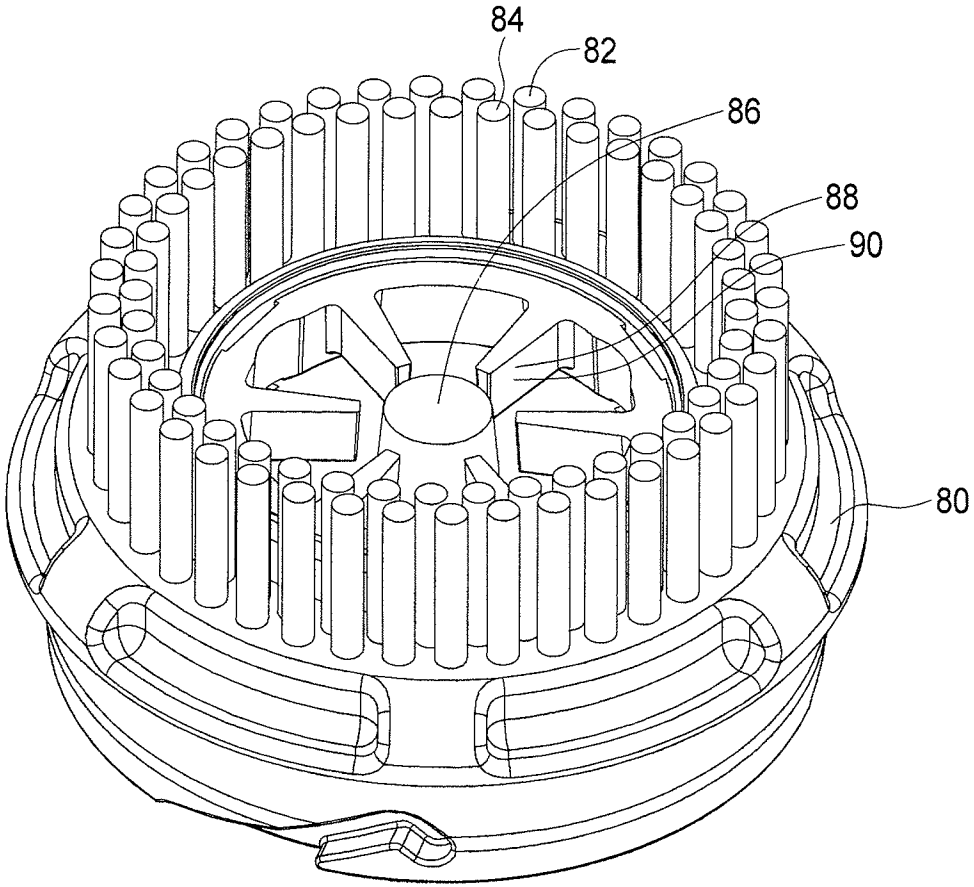
FIG. 5 is a schematic view of yet another embodiment of the brushhead and accompanying makeup remover element.

FIG. 5 shows yet another embodiment illustrating a different oscillating inner brushhead portion. The embodiment includes a base element 80 and two outer rings 82 and 84 which are fixed in position, having the same configuration and material as the base element and the two outer fixed rings for the other embodiments. The inner brushhead portion, however, does not include elastomeric elements or bristles, but rather comprises a wheel-like arrangement with a central inner hub 86, an outer hub 88 and a plurality of spaced vanes 90 which extend from the outer hub in the direction of the central hub, terminating a short distance (almost touching) therefrom. In the embodiment shown, the central hub is approximately 3/16-inch high, approximately 1/4-inch in diameter and slightly conical. The outer hub is approximately 3/16-inch high and approximately 1/8-inch thick, with an outside diameter of 1 1/8 inches. In the embodiment shown, there are six equally spaced vanes, but this number could vary. The vanes are slightly tapered from the outer hub 88 to their termination point adjacent the inner hub 86. The vanes in particular are made of a flexible plastic, such as silicone TPE, so that when the inner brushhead portion oscillates, the vanes also oscillate, rubbing against the lower surface of the solid, semi-solid, gel or the like balm tablet, so that energy from the oscillating action is coupled into the tablet, producing sufficient shear so that the non-Newtonian balm tablet changes from a solid, semi-solid, gel or the like to a liquid for subsequent application to the skin. In an embodiment, a semi-solid non-Newtonian balm is partially anchored by the vanes. In an embodiment, the vanes provide a mechanical strain to a semi-solid non-Newtonian balm so as to cause a change in state. There are openings being adjacent vanes so that the tablet can be pressed against the vanes and slightly into the openings, holding it in place during movement of the appliance from the horizontal position to the operational position against the skin for use.

Hence, various embodiments of a brushhead have been described which are capable of holding a solid non-Newtonian balm tablet having makeup removal capabilities in place during movement of the appliance, and when the inner brushhead portion oscillates at a frequency and amplitude within selected ranges, shear force is produced on the tablet sufficient that it changes from a solid, semi-solid, gel or the like form to a liquid form. The liquid then moves onto the skin, where the oscillating action of the brushhead and the fixed outer rings both lift off the accumulated makeup and remove it from the skin. Typically, existing makeup will be effectively and conveniently removed.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. A brushhead for use with a non-Newtonian cosmetic composition, comprising:

a brushhead base member, the base member remaining fixed in position relative to an associated appliance during operation of the appliance;

at least one outer ring of bristles mounted on the base member and adapted for comfortable contact with the skin; and an inner brushhead portion adapted to capture a solid, semi-solid or gel non-Newtonian cosmetic composition which has shear thinning characteristics, the inner portion further adapted to receive energy by virtue of an oscillating action on the inner portion produced by a motor assembly in the appliance to which the brushhead is attachable, wherein oscillation of the inner portion at a selected frequency and amplitude results in a change of state of the non-Newtonian cosmetic composition from solid, semi-solid or gel to liquid, wherein the inner brushhead portion includes a plurality of rings of bristles having the same height as the outer ring of bristles and further includes at least two rings of elastomeric protrusions surrounding the inner portion bristles between the inner portion bristles and the outer bristles, and wherein the protrusions are shorter than the inner portion bristles, and wherein the solid, semi-solid or gel non-Newtonian cosmetic composition is doughnut shaped, with the inner portion bristles extending through a central doughnut opening when the solid, semi-solid or gel non-Newtonian cosmetic composition is positioned on the brushhead.

2. The brushhead of claim 1, wherein the liquid is useful in makeup removal.

3. The brushhead of claim 1, including two fixed concentric outer rings of bristles, and wherein the inner brushhead portion includes at least two concentric rings of bristles.

4. The brushhead of claim 3, wherein the inner portion bristles are the same height as the outer rings of bristles with a height of approximately 0.425 inches, and comprise 3 mil DuPont supersoft filaments.

5. The brushhead of claim 1, wherein the elastomeric protrusions are approximately 0.06 inches high and have a diameter of 0.06 inches.

6. The brushhead of claim 1, including four rings of inner brushhead portion bristles.

7. The brushhead of claim 1, wherein the frequency of oscillation of the inner brushhead portion is in the range of 135-175 Hz, and wherein the amplitude ranges from about 3° to 18° to assist in producing a shear thinning effect.

* * * * *